US010514160B2

(12) United States Patent
Verdes et al.

(10) Patent No.: US 10,514,160 B2
(45) Date of Patent: Dec. 24, 2019

(54) LIGHT FIXTURE MOUNT FOR LIGHT FIXTURES IN HAZARDOUS LOCATIONS

(71) Applicant: Dialight Corporation, Farmingdale, NJ (US)

(72) Inventors: Anthony Verdes, Brick, NJ (US); Samual Boege, Pine Beach, NJ (US)

(73) Assignee: Dialight Corporation, Farmingdale, NJ (US)

( * ) Notice: Subject to any disclaimer, the term of this patent is extended or adjusted under 35 U.S.C. 154(b) by 0 days.

(21) Appl. No.: 15/826,300

(22) Filed: Nov. 29, 2017

(65) Prior Publication Data

US 2019/0162401 A1 May 30, 2019

(51) Int. Cl.

| | |
|---|---|
| ***F21V 31/00*** | (2006.01) |
| ***F21V 21/14*** | (2006.01) |
| ***F21V 25/12*** | (2006.01) |
| ***F21S 8/08*** | (2006.01) |
| ***F21V 23/00*** | (2015.01) |
| *F21V 17/12* | (2006.01) |
| *F21Y 115/10* | (2016.01) |

(52) U.S. Cl.

CPC ..... *F21V 31/005* (2013.01); *F21S 8/085* (2013.01); *F21V 21/14* (2013.01); *F21V 23/001* (2013.01); *F21V 25/12* (2013.01); *F21V 17/12* (2013.01); *F21Y 2115/10* (2016.08)

(58) Field of Classification Search

CPC ..... F21V 31/005; F21V 21/14

USPC ..... 362/368

See application file for complete search history.

(56) References Cited

U.S. PATENT DOCUMENTS

| | | | | |
|---|---|---|---|---|
| 2,489,650 | A * | 11/1949 | Landrum | F21S 6/002 362/413 |
| 4,143,413 | A * | 3/1979 | Kelly | F21V 21/116 362/418 |
| 2006/0044820 | A1 | 3/2006 | Ruffin | |
| 2006/0176695 | A1* | 8/2006 | Gordin | H05B 41/392 362/263 |
| 2009/0040774 | A1 | 2/2009 | Avila et al. | |
| 2015/0260385 | A1 | 9/2015 | Brynjolfsson | |
| 2015/0345770 | A1 | 12/2015 | Badley | |
| 2017/0016611 | A1 | 1/2017 | Hodgson | |
| 2017/0167701 | A1 | 6/2017 | Erdener et al. | |

OTHER PUBLICATIONS

PCT Search Report and Written Opinion for International Application Serial No. PCT/US2018/62890, dated Feb. 8, 2019, pp. 1-10.

* cited by examiner

*Primary Examiner* — Michael G Lee
*Assistant Examiner* — David Tardif

(57) ABSTRACT

The present disclosure is directed to a light fixture mount. The light fixture mount includes a first end to receive a light fixture, a cap coupled to the light fixture that is coupled to the first end to form a first seal, and a second end to receive a collar that is coupled to a mounting member, wherein the collar comprises a sealed wire pass-through and a second seal is formed between the second end and the collar.

16 Claims, 7 Drawing Sheets

LIGHT FIXTURE MOUNT FOR LIGHT FIXTURES IN HAZARDOUS LOCATIONS

BACKGROUND

Manufacturing facilities use lights to illuminate areas. Light may be located in a variety of different areas including the ground, the ceiling, various railways, walkways, catwalks within a building, and the like. The lights may be free standing or light fixtures that are wired to a power source.

The light sources may include traditional halogen or xenon based light bulbs. However, industry has slowly moved to light emitting diode (LED) based light sources that consume less energy. The LED based light sources provided a sufficient amount of light and are more efficient.

Some manufacturing facilities may operate in a hazardous environment. As a result, light sources that are installed in these hazardous environments may have more requirements than a light source installed outdoors or in non-hazardous environments.

SUMMARY

In one embodiment, the present disclosure provides a light fixture mount. In one embodiment, the light fixture mount comprises a first end to receive a light fixture, a cap coupled to the light fixture that is coupled to the first coupling end to form a first seal, and a second end to receive a collar that is coupled to a mounting member, wherein the collar comprises a sealed wire pass-through and a second seal is formed between the second end and the collar.

In another embodiment, the present disclosure provides a light fixture mount. In one embodiment, the light fixture mount comprises a first piece and a second piece. The first piece comprises a first end to receive a light fixture, a cap coupled to the light fixture and coupled to the first end to form a first seal that seals a wiring connection between the light fixture and a power source from a hazardous environment, and a second end. The second piece comprises a first end that is coupled to a mounting member and a second end that comprises a sealed wire pass-through, wherein the second end is coupled to the second end of the first piece to form a second seal.

In one embodiment, the present disclosure provides a mounting system for a hazardous location light fixture. The mounting system comprises a slip fitter base and a collar. The slip fitter base comprises a knuckle end that is coupled to a corresponding end of the hazardous location light fixture, wherein wiring of the hazardous location light fixture and a power source is connected in the knuckle end, a cap coupled to the knuckle end to form a first seal, and a bottom end. The collar comprises a pole receiving end that is coupled to a pole and a slip fitter base receiving end that is coupled to the bottom end of the slip fitter base to form a second seal, wherein the slip fitter base receiving end comprises a sealed wire-pass through.

BRIEF DESCRIPTION OF THE DRAWINGS

The teaching of the present disclosure can be readily understood by considering the following detailed description in conjunction with the accompanying drawings, in which.

To facilitate understanding, identical reference numerals have been used, where possible, to designate identical elements that are common to the figures.

DETAILED DESCRIPTION

As discussed above, some manufacturing facilities may operate in a hazardous environment. These hazardous locations may generate harmful fumes and gases that may be ignitable. Light sources installed in these environments may require certain precautions to prevent explosions caused by sparks that could ignite the fumes or gases.

Currently, wired light fixtures are mounted on poles or conduits that do not properly seal the connection between the wires from the conduit to the wires in the light fixture. For example, a single piece slip fitter base may be used that attempts to seal the connections between the wires, but does not seal the conduit and the single piece slip fitter base. For example, gases and fumes could still leak into the slip fitter base from below the single piece slip fitter base, down the conduit and back up into the single piece slip fitter base.

Embodiments of the present disclosure provide a light fixture mount for light fixtures in a hazardous location. For example, the apparatus has a seal between the apparatus and the conduit to prevent fumes or gases from entering a slip fitter base from a bottom of the apparatus. The present disclosure provides a two piece design that provides a true seal for mounting light fixtures in a hazardous location. In addition, the apparatus may include a slip fitting that allows for an adjustable movement of the light fixture after being mounted.

Figure 1:
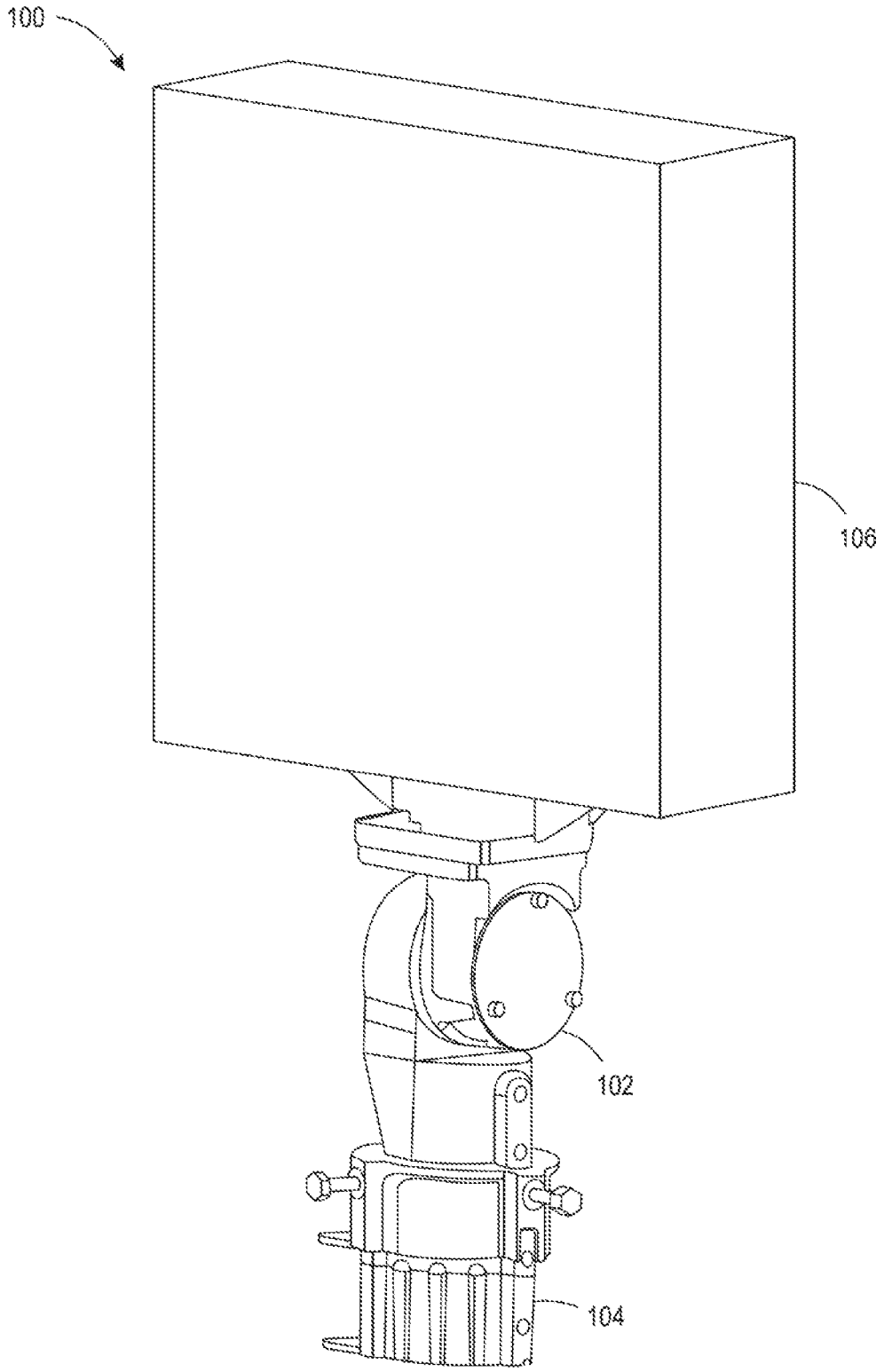
FIG. 1 depicts an isometric view of an example light fixture mount coupled to a light fixture of the present disclosure.

FIG. 1 illustrates an example of a light fixture mount 100 coupled to a light fixture 106. The light fixture 106 may be any type of hazardous location light fixture. For example, the light fixture 106 may be an explosion proof light fixture that is designed to operate in a Class I, Division I hazardous environment, or similarly categorized hazardous environments. The light fixture 106 may be a light emitting diode (LED) based light fixture.

In one embodiment, the light fixture mount 100 may include a first piece or a slip fitter base 102 and a second piece or a collar 104. In other words, the light fixture mount 100 of the present disclosure provides a two piece construction rather than previous light fixture mounts that provided a single piece construction. As a result, the light fixture mount 100 provides a superior seal at multiple points, as discussed below, as opposed to the inadequate sealing between the previous light fixture mount and a pipe, pole, or conduit that the previous light fixture mount was coupled to.

In one embodiment, the slip fitter base 102 and the collar 104 may be fabricated from a metal (e.g., steel, cast iron, and the like). However, it should be noted that the slip fitter base 102 and the collar 104 may be fabricated from any type of material (e.g., polymers and plastics) that are strong enough to support the weight of the light fixture 106.

In one example, the collar 104 may be coupled to a mounting member (discussed below). The slip fitter base 102 may then be coupled to the collar 104. The light fixture 106 may be coupled to the slip fitter base 102. The light fixture 106 may be aimed (e.g., a direction along a horizontal or 360 degrees around a vertical axis) and angled (e.g., a vertical direction or 360 degrees around a horizontal axis) and the collar may be tightened to the mounting member.

In one embodiment, and discussed in further detail below, the light fixture mount 100 of the present disclosure provides a seal between the collar 104 and the mounting member. As a result, the light fixture mount 100 provides an additional seal to ensure that harmful gases and vapors cannot move up the collar, down into the mounting member, and then back up into the light fixture mount 100 where electrical wires are connected.

In contrast, previous light fixture mounts for hazardous locations only provided a seal where the electrical wires are located, but did not provide a seal between the mounting member and the previous light fixture mounts. As a result, vapors and gases could still enter the location where the electrical wires were located, which could lead to a fire or explosion.

Figure 2:
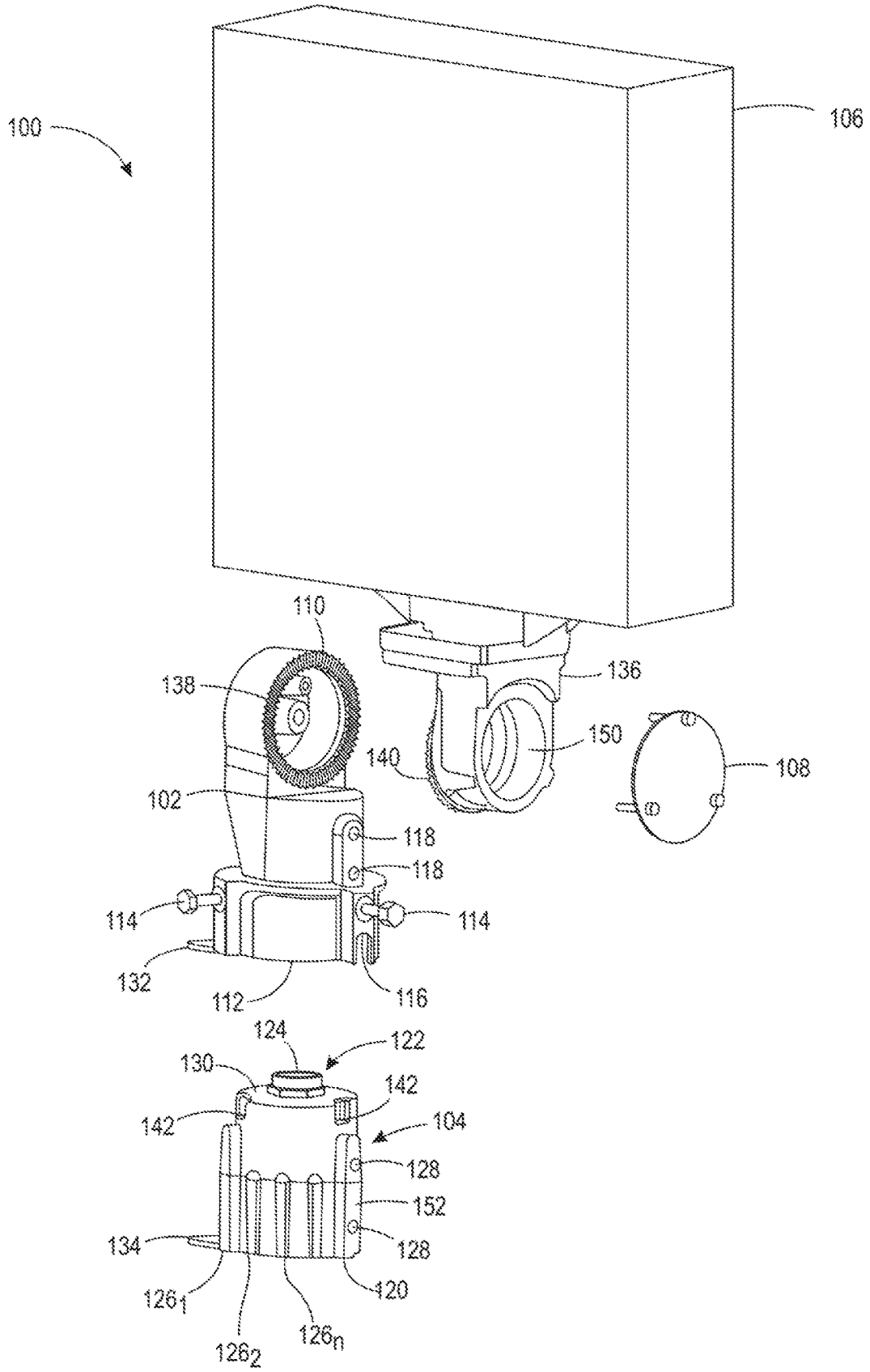
FIG. 2 depicts an isometric exploded view of the example light fixture mount of the present disclosure.

FIG. 2 illustrates an exploded view of the example light fixture mount 100. In one embodiment, the slip fitter base 102 may include a first end 110 and a second end 112. In one embodiment, the first end 110 may include an opening that is positioned perpendicular to an opening of the second end 112. The perpendicular positioning of the first end 110 and the second end 112 allows an angle of the light fixture 106 to be adjusted vertically when attached to the first end 110, while allowing the second end 112 to be coupled to the collar 104, as discussed below.

The first end 110 may also be referred to as a knuckle end that includes a slip fitter coupling 138. The slip fitter coupling 138 may have a circular shape and include teeth around a perimeter of the first end 110. The slip fitter coupling 138 may mate with a corresponding slip fitter coupling 140 of the light fixture 106 to form a seal. The corresponding slip fitter coupling 140 may also have a circular shape and include teeth around a perimeter.

In one embodiment, the corresponding slip fitter coupling 140 may be part of a slip fitter attachment 136. The slip fitter attachment 136 may be coupled to older light fixtures 106 to allow the older light fixtures 106 to be retro-fitted to the light fixture mount 100. The slip fitter attachment 136 may include a captive pivot bolt (shown in FIG. 7 and discussed below) to secure the light fixture 106 into position after adjustments are made.

In one embodiment, the slip fitter coupling 138 and the corresponding slip fitter coupling 140 may mate in different positions to allow the light fixture 106 to be angled at different positions (e.g., different vertical angles, up and down, or 360 degrees around an imaginary horizontal axis that goes through the first end 110). The granularity of the different positions may be a function of how large the teeth are, or a number of teeth that are included, on the slip fitter coupling 138 and the corresponding slip fitter coupling 140.

In one embodiment, wiring from a power source and wiring of the light fixture 106 (discussed below) may be connected in a volume 150. For example, wiring may be fed through the first end 110 and through an opening in the corresponding slip fitter coupling 140 into the volume 150. The volume 150 may then be sealed by a cap 108. The cap 108 may be coupled to the light fixture 106 that is coupled to the first end 110 to form a first seal. For example, the cap 108 may be coupled to an opposite side of the corresponding slip fitter coupling 140 of the light fixture 106.

In one embodiment, the second end 112 may include an opening that fits over a second end 122 of the collar 104, as discussed in further detail below. The dimensions of the opening of the second end 112 may be larger than the dimensions of the second end 122 of the collar 104. The second end 112 may include a cut-out 116 that may be used to align one or more coupling members 114 to one or more corresponding openings 142 of the collar 104.

In one embodiment, the one or more coupling members 114 may be captive hardware. In other words, the one or more coupling members 114 may be loosened or tightened, but fixed to the slip fitter base 102 such that they do not fall out. In addition, the one or more coupling members 114 may be inserted horizontally. Providing captive hardware and inserting the one or more coupling members 114 horizontally may allow for easier installation by a single technician.

In one embodiment, the one or more coupling members 114 may be any type of mechanical coupling. For example, the one or more coupling members 114 may be a bolt, a screw, a fastener, a clip, and the like.

In one embodiment, the slip fitter base 102 may also include one or more adjustment screws 118. The adjustment screws 118 may be tightened to further secure the slip fitter base 102 to the collar 104 or a mounting member.

In one embodiment, the collar 104 may include a pole receiving end or a first end 120 and a slip fitter base receiving end or a second end 122 referred to above. In one embodiment, the first end 120 may have an opening that is sized to fit a mounting member or a pole. The first end 120 may be placed over the mounting member and coupled to the mounting member via one or more adjustment screws 128. The collar 104 may be rotated to a desired position and then locked into place by tightening the one or more adjustment screws 128 against the mounting member.

In one embodiment, the collar 104 may include a plurality of protrusions $126_1$ to $126_n$ (herein also referred to individually as a protrusion 126 or collectively as protrusions 126). The protrusions 126 may have any shape, e.g., a vertically elongated shape The protrusions 126 may be located along an exterior side, or exterior perimeter, of the collar 104. The protrusions 126 provide a grip to allow a user to rotate, or move, the collar 104.

In one embodiment, at least one of the protrusions 126 may be larger than, longer than, or extend vertically past the other remaining protrusions 126. For example, the protrusion 152 may extend vertically past the other remaining protrusions 126. The protrusion 152 may be aligned with an opening 142 that receives a coupling member 114. The cut-out 116 may be positioned to fit over the protrusion 152 and align the opening 142 to receive the coupling member 114. Thus, the combination of the cut-out 116 on the second end 112 of the slip fitter base 102 and the vertically extended protrusion 152 provides an alignment feature to easily couple the slip fitter base 102 to the collar 104.

In one embodiment, the second end 122 may include a sealed wire pass-through 124 and a gasket 130. The sealed wire pass-through 124 may be located approximately in a center of the second end 122 of the collar 104.

In one embodiment, the gasket 130 may be formed of a flexible material such as a rubber, a foam, a plastic, and the like. The gasket 130 may be located around a perimeter on an outermost edge of a top side of the second end 122. Said another way, the gasket 130 may have a donut shape that is fitted around the sealed wire pass-through 124. For example, on a top surface of the second end 122, the gasket 130 may cover an outer perimeter of the top surface around the sealed wire pass-through 124.

As discussed in further detail below, an inner portion of the collar 104 may rest against the gasket 130 to form a second seal between the slip fitter base 102 and the collar 104. The second seal prevents vapor or gasses from being able to enter into the volume 150 inside of the slip fitter base 102 that may contain electrical wiring.

In one embodiment, the sealed wire pass-through 124 may allow electrical wiring to pass through from the mounting member and up into the slip fitter base 102. However, the sealed wire pass-through 124 creates a third seal between the mounting member and the collar 104. As a result, the second seal and the third seal ensure that harmful vapors and/or gases cannot enter up the collar 104 from the mounting member and back up into the slip fitter base 102. Notably, previous light fixture mounts for hazardous locations did not provide these additional seals. As a result, the previous light fixture mounts were not truly explosion proof.

In one embodiment, the slip fitter base 102 and the collar 104 may include a safety tab 132 and 134, respectively. The safety tabs 132 and 134 may be used to further secure the light fixture 106. For example, a wire or cord may be looped through the safety tab 132 and/or 134 and secured to the light fixture 106. As a result, if the connection between the slip fitter 138 and the corresponding slip fitter coupling 140 fail, the collar 104 loses its connection, or any other type of mechanical failure, the light fixture 106 may still be secured.

Figure 3:
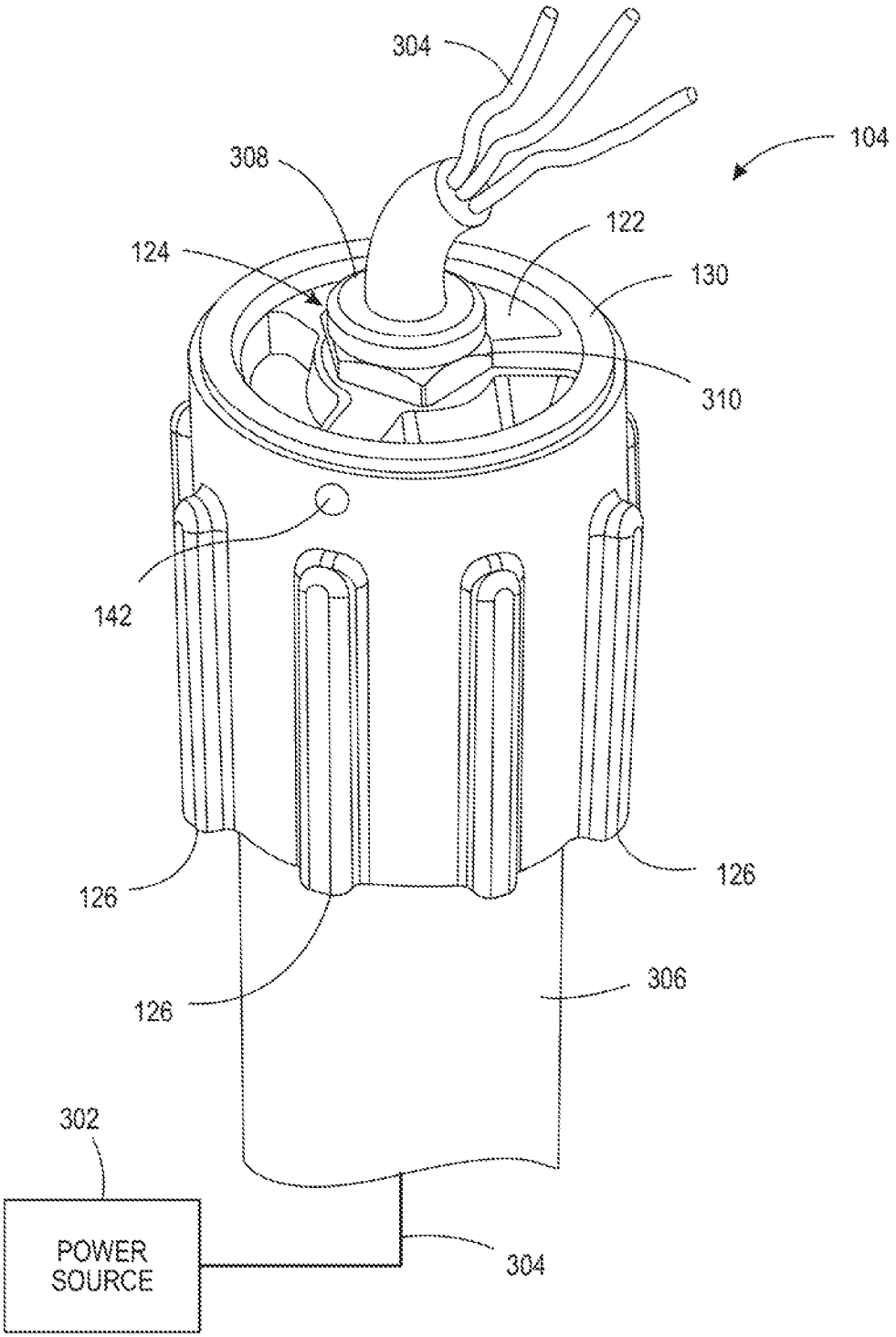
FIG. 3 depicts an isometric view of an example collar of the light fixture mount coupled to a pole of the present disclosure.

FIG. 3 illustrates an isometric view of the collar 104 on a mounting member 306. The mounting member 306 may be a pole, a conduit, a pipe, or any other apparatus that a light fixture may be mounted onto.

In one embodiment, a power source 302 may provide power to the light fixture 106. The power source 302 may be any type of alternating current (AC) or direct current (DC) power source of any voltage necessary to operate the light fixture 106. In one embodiment, wiring 304 may be run from the power source 302 through the mounting member 306 and up through the sealed wire pass-through 124.

In one embodiment, the sealed wire pass-through 124 may include a cord grip 308 and a tightening nut 310. The cord grip 308 may be a flexible tube with an opening or slit inside of the tightening nut 310. For example, the cord grip 308 may be fabricated from rubber, plastic, and the like. The cord grip 308 may "hold" the wiring 304 to prevent the wiring 304 from falling back down into the mounting member 306.

In one embodiment, after the proper amount of wiring 304 is passed through the cord grip 308, the tightening nut 310 may be tightened to form the third seal around the wiring 304. After the tightening nut 310 is tightened around the cord grip 308 to form the third seal, vapors and gasses may be prevented from entering through the sealed wire pass-through 124.

Figure 4:
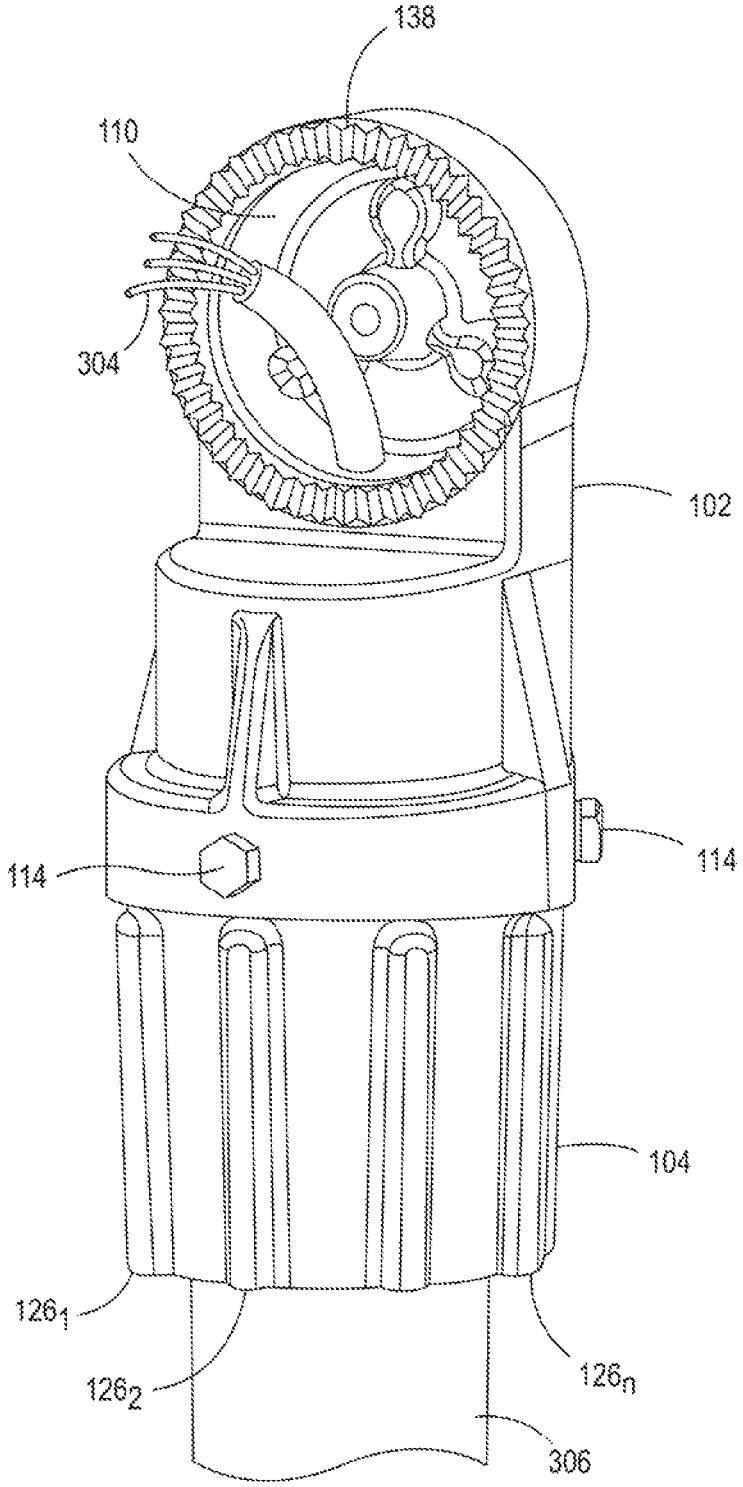
FIG. 4 depicts an isometric view of an example slip fitter base of the light fixture mount coupled to the collar of the present disclosure.

FIG. 4 illustrates an isometric view of the slip fitter base 102 coupled to the collar 104 on the mounting member 306. As noted above, the opening in the second end 112 of the slip fitter base 102 may be placed over the second end 122 of the collar 104. The slip fitter base 102 may be coupled to the collar 104 via the one or more coupling members 114. The wire 304 may be pulled through the slip fitter base 102 and out of the first end 110 of the slip fitter base 102.

Figure 5:
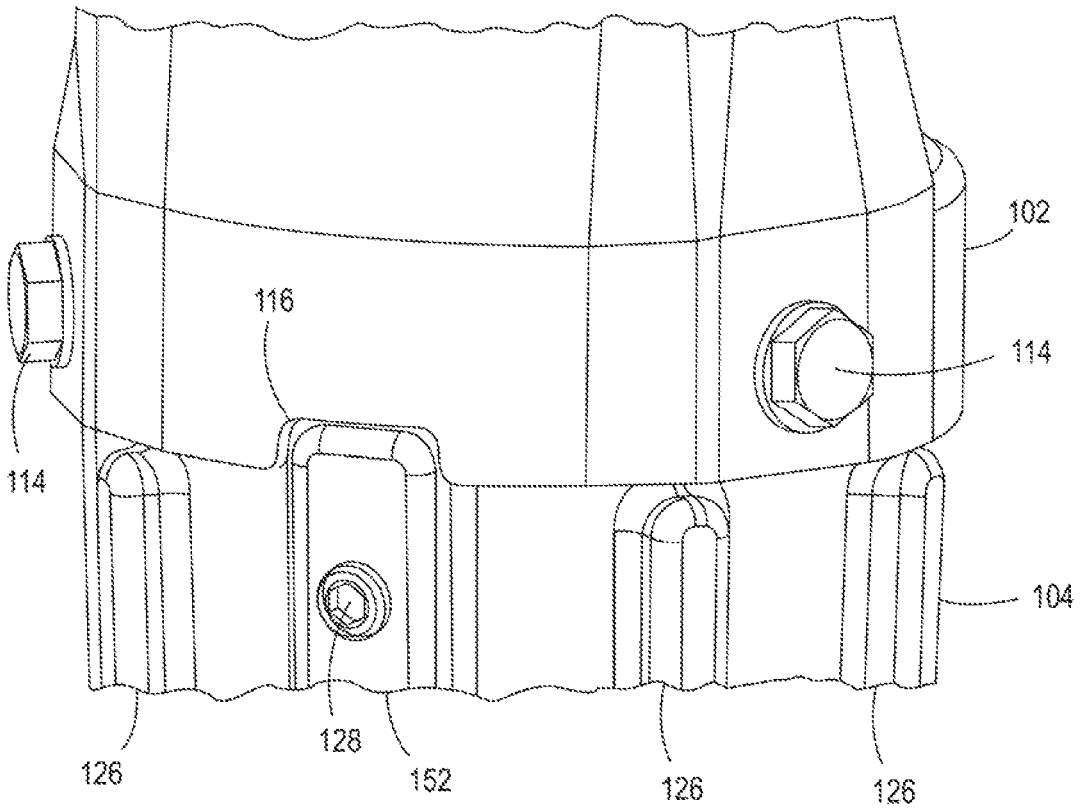
FIG. 5 depicts a side view of a cut-out in the example slip fitter base of the present disclosure.

FIG. 5 illustrates a side view of the cut-out 116 of the slip fitter base 102. As discussed above, the shape of the cut-out 116 may correspond to a shape of a top of protrusion 152 that vertically extends past the remaining protrusions 126. For example, FIG. 5 illustrates the top of the protrusion 152 having a rectangular shape with rounded corners. As a result, the cut-out 116 may also have a rectangular shape with rounded corners. Although one example shape is illustrated in FIG. 5, it should be noted that the cut-out 116 and a top of the protrusion 152 may have any type of shape that correspond to one another. It should be noted that although a single protrusion 152 that vertically extends past the remaining protrusions 126 and a single cut-out 116 is illustrated in FIGS. 2 and 5, that any number of protrusions 152 and corresponding cut-outs 116 may be used for alignment.

In one embodiment, the cut-out 116 may be formed in a bottom edge or perimeter of the slip fitter base 102. In other words, a bottom surface along an outer perimeter of the second end 112 of the slip fitter base 102 may have a depression that appears as a cut-out when viewed from the side. As noted above, the cut-out 116 may be aligned with the protrusion 152 to help a user align the one or more coupling members 114 to corresponding openings 142 in the collar 104. When the cut-out 116 is aligned with the protrusion 152, the user may know that the one or more coupling members 114 are aligned with the corresponding openings 142 in the collar 104. This provides a more efficient alignment mechanism than manually rotating the slip fitter base 102 around the collar 104 by trial and error until the coupling members 114 are aligned with the corresponding openings 142 in the collar 104.

Figure 6:
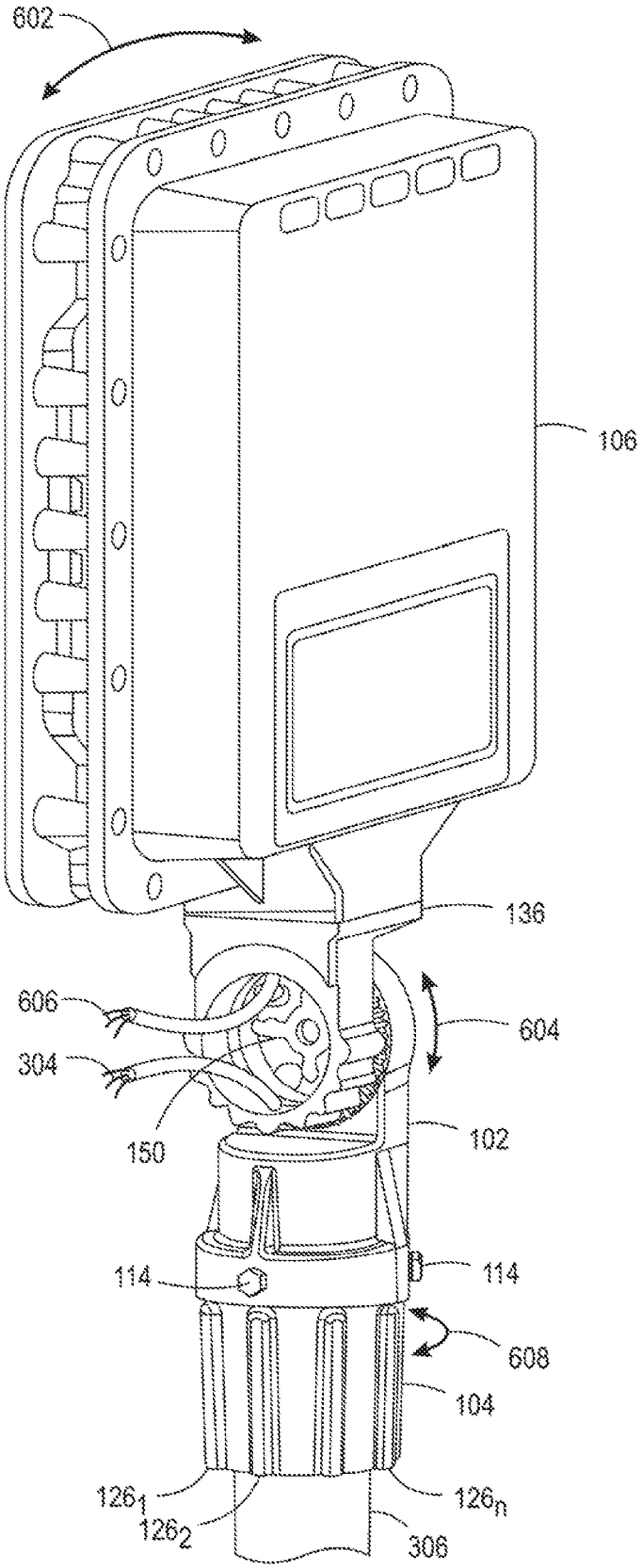
FIG. 6 depicts an isometric view of the example light fixture coupled to the slip fitter base of the present disclosure.

FIG. 6 illustrates an isometric view of the light fixture 106 coupled to the slip fitter base 102. In one embodiment, the corresponding slip fitter coupling 140 may be coupled to the slip fitter 138 to allow the light fixture 106 to be adjusted vertically, as noted above. For example, the corresponding slip fitter coupling 140 may be rotated around the slip fitter 138 as shown by an arrow 604. As a result, the light fixture 106 may be aimed at different vertical angles as shown by an arrow 602.

In one embodiment, a wiring 606 of the light fixture 106 and the wiring 304 of the power source 302 may be fed to the volume 150. The wiring 606 and the wiring 304 may be electrically connected in the volume 150. The cap 108 may then seal the volume 150 where the wiring 606 and the wiring 304 are connected.

In one embodiment, the collar 104 may be rotated around the mounting member 306 to aim the light fixture 106 in a proper horizontal direction (as shown by an arrow 608). After the light fixture 106 is aimed in the proper horizontal direction, the adjustment screws 128 (shown in FIGS. 2 and 7) can be tightened to securely couple the collar 104 to the mounting member 306.

Figure 7:
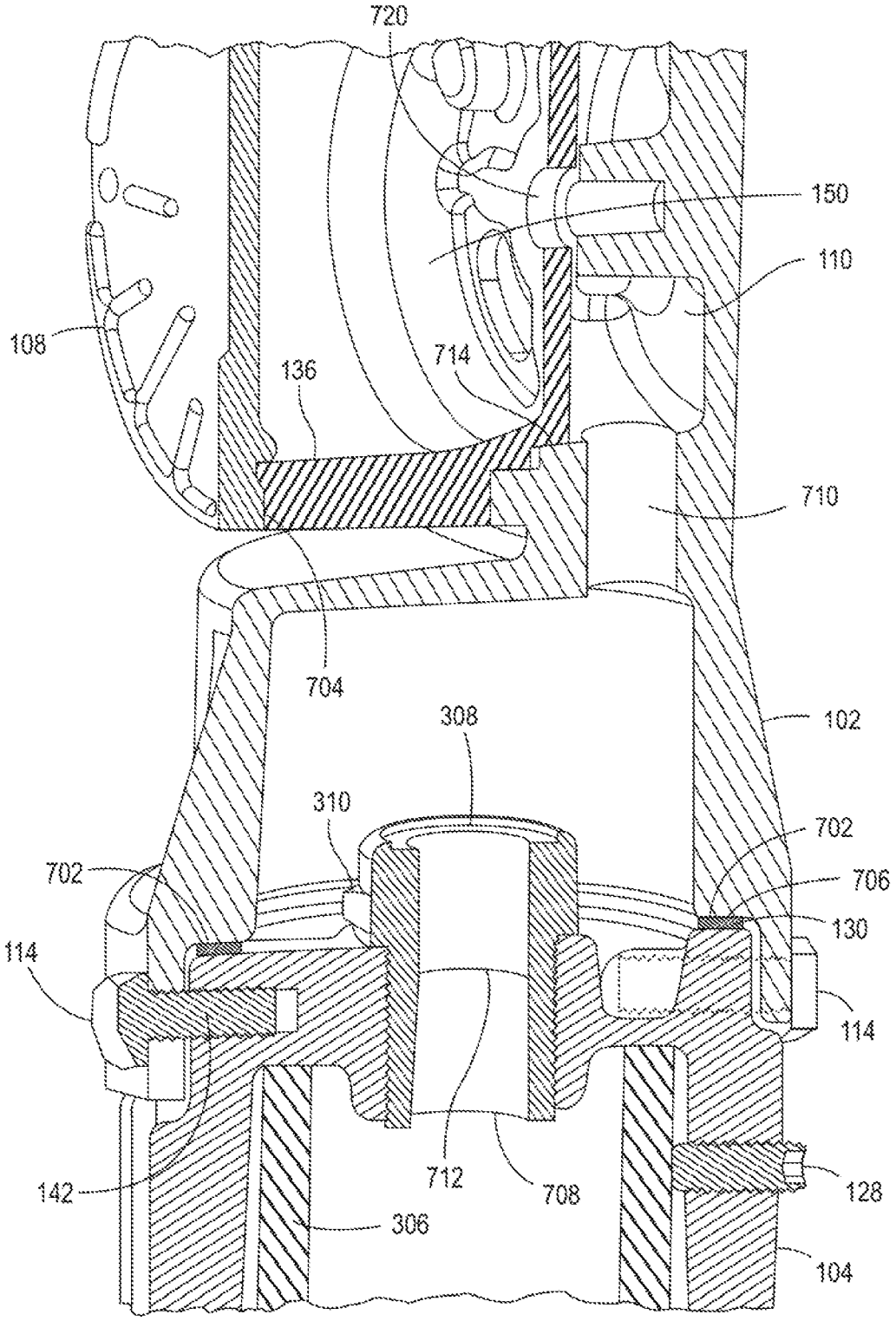
FIG. 7 depicts a cross-sectional view of the example light fixture mount.

FIG. 7 illustrates a cross-sectional view of the light fixture mount 100. FIG. 7 illustrates an interior volume of the connections and seals that are formed when the slip fitter base 102, the collar 104, and the mounting member 306 are coupled together.

As discussed above, the wiring 304 may be fed through wire passageways 708 and 710 up into the volume 150. The wiring 606 and the wiring 304 may then be connected in the volume 150 and sealed by the cap 108. The cap 108 may form a first seal 704 that prevents harmful gases and vapors from entering the volume 150.

In one embodiment, the slip fitter base 102 may include an inner surface 702. The inner surface 702 may be an approximately flat surface adjacent to an inner wall of the slip fitter base 102. The inner surface 702 may be a "ledge" or a donut shaped surface. The inner surface 702 may be located closer to the second end 112 than the first end 110 relative to a length of the wall of the slip fitter base 102. When the slip fitter base 102 is placed over the second end 122 of the collar 104, the inner surface 702 may rest against the gasket 130 to form a seal 706. The seal 706 may prevent vapors or gases from entering the inside of the slip fitter base 102 and up through the wire passage way 710 into the volume 150 where the electrical connections are made In another embodiment, the inner surface 702 may be a bottom surface of the second end 112 of the slip fitter base 102. For example, rather than "inserting" the second end 122 of the collar 104 into the second end 112 of the slip fitter base 102, the second end 112 may rest on top of the gasket 130 and the second end 122 of the collar 104. The one or more coupling members 114 and the one or more corresponding openings 142 may be deployed as tabs around an outer circumference of the slip fitter base 102 and the collar 104, respectively. The one or more coupling members 114 may then be inserted vertically (as opposed to horizontally as shown in FIGS. 2 and 7, and described above) into the one or more corresponding openings 142.

In one embodiment, the wiring 304 may be fed through the cord grip 308, as discussed above. The tightening nut 310 may be tightened against the cord grip 308 and the wiring 304 to form a seal 712. The seal 712 may prevent harmful vapors and gases from moving up through the mounting member 306 into the slip fitter base 102, up through the wire passage way 710 into the volume 150 where the electrical connections are made.

Thus, the two piece design of the light fixture mount 100 provides a true explosion proof design for hazardous locations. The light fixture mount 100 creates four seals 704, 706, 712, and 714 at the four possible entry points for vapors or gases. For example, the seal 704 may be between the cap 108 and the slip fitter attachment 136. The seal 706 may be formed by the gasket 130 and the inner surface 702. The seal 712 may be formed by the cord grip 308 inside the wire passageways 708. The seal 714 may be formed between the slip fitter attachment 136 and the slip fitter base 102. As a result, vapors or gases are prevented from entering the volume 150 where electrical connections could ignite the vapors or gases.

As noted above, the slip fitter attachment 136 may include a pivot bolt 720. The pivot bolt 720 may be a captive bolt threaded through a center opening of the slip fitter attachment 136. The pivot bolt 720 may be used to secure the light fixture 106 into position after adjusting the position of the light fixture 106 as described above.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

What is claimed is:

1. A light fixture mount, comprising:
- a first end to receive a light fixture;
- a cap coupled to the light fixture that is coupled to the first end to form a first seal; and
- a coupling end to receive a collar that is coupled to a mounting member, wherein the collar comprises a sealed wire pass-through and a gasket around a perimeter to form a second seal is formed between a second end and the collar, wherein the sealed wire pass-through comprises a cord grip fed through a tightening nut to form a third seal.

2. The light fixture mount of claim 1, wherein the first end comprises a slip fitter coupling that mates with a corresponding slip fitter coupling on the light fixture.

3. The light fixture mount of claim 1, wherein the first end is perpendicular to the second end.

4. The light fixture mount of claim 1, wherein the second end comprises one or more coupling members that are coupled to one or more corresponding holes in the collar.

5. The light fixture mount of claim 4, wherein the second end comprises a cut-out to align the one or more coupling members to the one or more corresponding holes in the collar.

6. The light fixture mount of claim 4, wherein the one or more coupling members are captive.

7. A light fixture mount, comprising:
- a first piece, wherein the first piece comprise:
  - a first end to receive a light fixture;
  - a cap coupled to the light fixture and coupled to the first end to form a first seal that seals a wiring connection between the light fixture and a power source from a hazardous environment; and
  - a second end; and
- a second piece, wherein the second piece comprises:
  - a first end that is coupled to a mounting member; and
  - a second end that comprises a sealed wire pass-through, wherein the second end of the second piece comprises a gasket around a perimeter of the second end and is coupled to the second end of the first piece to form a second seal, wherein the sealed wire pass-through, comprises:
    - a cord grip; and
    - a tightening nut coupled to the cord grip, wherein the tightening nut forms a third seal between the second piece and the mounting member.

8. The light fixture mount of claim 7, wherein the first end of the first piece comprises a slip fitter coupling that mates with a corresponding slip fitter coupling on the light fixture.

9. The light fixture mount of claim 7, wherein the second end of the first piece comprises an inner surface that rests against the gasket to form the second seal between the second end of the first piece and the second end of the second piece.

10. The light fixture mount of claim 7, wherein the second piece comprises a plurality of protrusions around an exterior side of the second piece.

11. The light fixture mount of claim 10, wherein one of the plurality of protrusions is extended vertically past remaining protrusions of the plurality protrusions.

12. The light fixture mount of claim 11, wherein the second end of the first piece comprises:
- one or more bolts; and
- a cut-out along a perimeter of the second end of the first piece that aligns the one or more bolts of the second end of the first piece to one or more corresponding openings in the second end of the second piece.

13. The light fixture mount of claim 12, wherein the one or more bolts are captive.

14. The light fixture mount of claim 12, wherein the one or more bolts are coupled horizontally to the one or more corresponding openings in the second end of the second piece.

15. A mounting system for a hazardous location light fixture, comprising:
- a slip fitter base, the slip fitter base comprising:
  - a knuckle end that is coupled to a corresponding end of the hazardous location light fixture, wherein wiring of the hazardous location light fixture and a power source is connected in the knuckle end;

a cap coupled to the knuckle end to form a first seal; and a bottom end; and a collar, the collar comprising:

a pole receiving end that is coupled to a pole; and a slip fitter base receiving end comprising a gasket around a perimeter of the slip fitter base receiving end that is coupled to the bottom end of the slip fitter base to form a second seal, wherein the slip fitter base receiving end comprises a sealed wire-pass through, wherein the sealed wire pass-through, comprises:

a cord grip; and a tightening nut coupled to the cord grip, wherein the tightening nut forms a third seal between the collar and the pole.

16. The mounting system of claim 15, wherein the bottom end of the slip fitter base comprises an inner surface that rests against the gasket when the slip fitter base receiving end is inserted into an opening of the bottom end of the slip fitter base.

* * * * *